US007520407B2

(12) United States Patent
Crosby et al.

(10) Patent No.: US 7,520,407 B2
(45) Date of Patent: Apr. 21, 2009

(54) PERSONAL DENTAL CARE UNIT

(76) Inventors: Maxine Crosby, The Daytona Lighthouse Inn, 1227 N. Atlantic Ave., Daytona Beach, FL (US) 32118; Michael Crosby, The Daytona Lighthouse Inn, 1227 N. Atlantic Ave., Daytona Beach, FL (US) 32118

( * ) Notice: Subject to any disclaimer, the term of this patent is extended or adjusted under 35 U.S.C. 154(b) by 594 days.

(21) Appl. No.: 11/126,353

(22) Filed: May 11, 2005

(65) Prior Publication Data

US 2006/0255065 A1 Nov. 16, 2006

(51) Int. Cl.
*B65D 35/28* (2006.01)

(52) U.S. Cl. ..... 222/102; 222/93; 222/106; 222/181.3

(58) Field of Classification Search ..... 222/101, 222/102, 93, 181.1, 95, 181.2, 106, 180, 222/181.3, 182
See application file for complete search history.

(56) References Cited

U.S. PATENT DOCUMENTS

| | | | | | |
|---|---|---|---|---|---|
| 1,841,275 | A | * | 1/1932 | Baptiste | 222/96 |
| 2,064,357 | A | * | 12/1936 | Ritterbusch | 222/93 |
| 2,605,932 | A | | 8/1952 | Locke | |
| 2,822,111 | A | | 2/1958 | Tripoli | |
| 3,860,147 | A | * | 1/1975 | Vessio et al. | 222/96 |
| 3,917,118 | A | | 11/1975 | Ogden | |
| 4,010,871 | A | | 3/1977 | Broadie | |
| 5,203,473 | A | | 4/1993 | Willey | |
| 5,215,218 | A | * | 6/1993 | Choi | 222/63 |
| 5,449,092 | A | | 9/1995 | Bazan | |
| 5,638,840 | A | | 6/1997 | Lee et al. | |
| 5,676,279 | A | | 10/1997 | Bastion | |
| 5,845,813 | A | | 12/1998 | Werner | |
| 5,871,124 | A | | 2/1999 | Wilkinson | |
| 5,873,495 | A | | 2/1999 | Saint-Germain | |
| 5,975,362 | A | | 11/1999 | West | |
| 6,047,712 | A | | 4/2000 | Blades et al. | |
| 6,481,599 | B1 | | 11/2002 | DeVaux | |
| 2001/0050290 | A1 | * | 12/2001 | Sampson et al. | 222/102 |
| 2002/0166874 | A1 | | 11/2002 | DeVaux | |
| 2003/0024546 | A1 | | 2/2003 | Linttell | |
| 2004/0040890 | A1 | | 3/2004 | Chen | |
| 2004/0040980 | A1 | * | 3/2004 | Chen | 222/101 |

FOREIGN PATENT DOCUMENTS

| | | |
|---|---|---|
| DE | 10128034 | 12/2002 |
| GB | 2025515 | 1/1980 |
| GB | 2113172 | 8/1983 |

* cited by examiner

*Primary Examiner*—J. Casimer Jacyna
(74) *Attorney, Agent, or Firm*—Richard C. Litman

(57) ABSTRACT

The personal dental care unit provides a single device for the storage and containment of most articles used in personal dental care in the household, e.g., toothpaste, toothbrushes, and dental floss. The device attaches to a wall at a convenient location near a bathroom sink or the like, and includes a mechanism for affixing a tube of toothpaste therein and dispensing the toothpaste efficiently. Opposed rollers grip the tube and squeeze toothpaste from the tube as they are advanced by a roller advance screw along the tube. The tube is supported by a support bracket which is adjustable for different sizes of tubes. The tube and mechanism are enclosed in a cover, with the cover including a rack for holding toothbrushes and a receptacle for holding a small packet of dental floss. The cover may be provided with any form of complementary or contrasting decor or pattern, as desired.

12 Claims, 4 Drawing Sheets

PERSONAL DENTAL CARE UNIT

BACKGROUND OF THE INVENTION

1. Field of the Invention

The present invention relates generally to article holders and dispensers. More particularly, the present invention is a personal dental care unit, which attaches to a wall surface, e.g., in a bathroom. The device includes a mechanism for dispensing toothpaste from a tube secured therein and may also include receptacles for a dental floss container and toothbrushes.

2. Description of the Related Art

Over the years, people have generally become increasingly concerned about good dental hygiene. Toothpaste and toothbrushes are used nearly universally, and many people also use dental floss at least occasionally. Typically, a tube of toothpaste is kept in a bathroom cabinet, with toothbrushes stored nearby in a holder near the bathroom sink or basin. A container of dental floss may also be stored in the bathroom cabinet. While these various articles relating to dental hygiene are kept in the same general area, they are not usually located immediately with one another for convenient access in one specific location.

Moreover, the toothpaste must be manually squeezed from its tube onto the bristles of the toothbrush when no dedicated dispenser is provided. While this is a simple act for most people, younger children often have difficulty in gauging the amount of pressure to apply to the tube and the quantity of toothpaste to squeeze from the tube. Many people, including adults, are not adept at manipulating the tube to use all of the contents, and toothpaste tubes are often discarded with a fairly significant percentage of their toothpaste contents remaining. Another common problem is the loss of the cap from a toothpaste tube, which may result in the contents drying and hardening in the neck of the tube, thereby requiring that the tube be discarded even though it may still contain a significant quantity of toothpaste.

While some related art addresses perhaps one or two of the above problems, the present inventors are not aware of any related art device which provides a single solution to all of the above problems relating to personal dental care. An example of one related art device is described in German Patent No. 10,128,034, published on Dec. 12, 2002. According to the drawings and English abstract, the device comprises a wall-mounted tube with an automatic closure. The closure has a tab extending therefrom, which is pushed back by the head of the toothbrush to open the tube. No mechanism for dispensing the toothpaste from the tube nor means for holding the toothbrush(es) and/or floss is apparent in the '034 German Patent Publication.

None of the related art of which the present inventors are aware, taken either singly or in combination, is seen to describe the instant invention as claimed. Thus, a personal dental care unit solving the aforementioned problems is desired.

SUMMARY OF THE INVENTION

The personal dental care unit provides a solution for all of the above problems by means of a single device, which may be mounted upon a wall surface adjacent to the bathroom basin or sink. The device includes a mechanism for precisely dispensing toothpaste from a tube secured therein, and a tube closure that remains attached to the device to preclude loss of the closure. The dispensing mechanism efficiently and progressively collapses the tube to provide for the dispensing of nearly all of the contents of the tube with virtually no waste. The tube is secured within the device with its outlet nozzle oriented downwardly, with the upper end of the tube immovably affixed within a clamp. Opposed rollers roll progressively down the sides of the tube as an advance screw is turned, thereby squeezing the toothpaste from the tube. The lower or outlet end of the tube is supported by an adjustable tube support bracket, which may be positionally adjusted within the device to accommodate different length toothpaste tubes. Toothbrushes are stored in a rack surrounding the device, and a receptacle for a conventional container of dental floss is also provided on the device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a personal dental care unit comprising a wall-mounted apparatus, which may contain or hold all of the products and accessories normally associated with daily personal dental hygiene and care. More specifically, the present device is a combination container and dispenser for holding a tube of toothpaste therein, and dispensing toothpaste therefrom as desired. The device also includes a toothbrush rack and an open container for holding a small packet of dental floss or the like.

Figure 1:
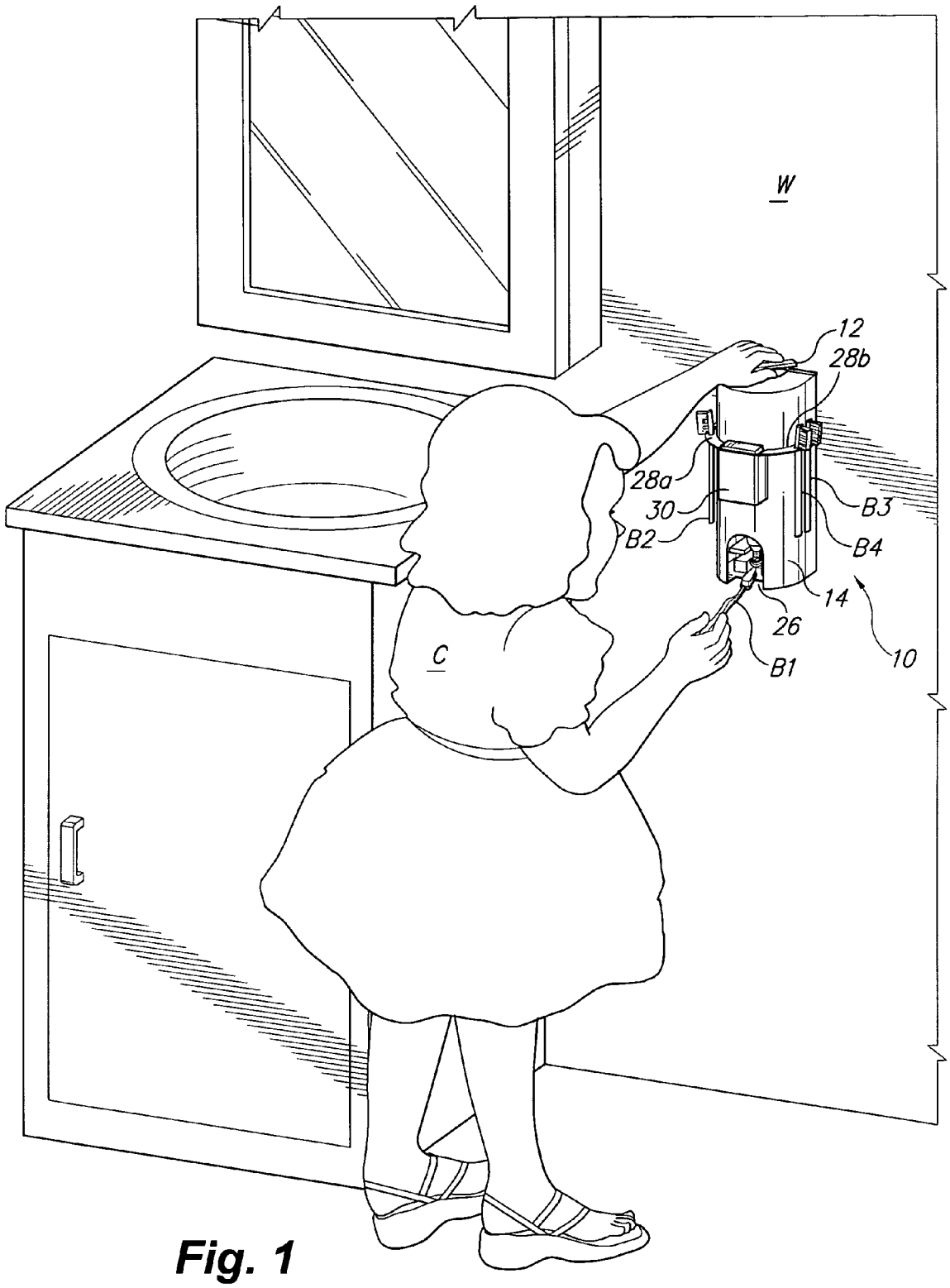
FIG. 1 is an environmental, perspective view of a personal dental care unit according to the present invention, showing an exemplary installation and its use.
Figure 2:
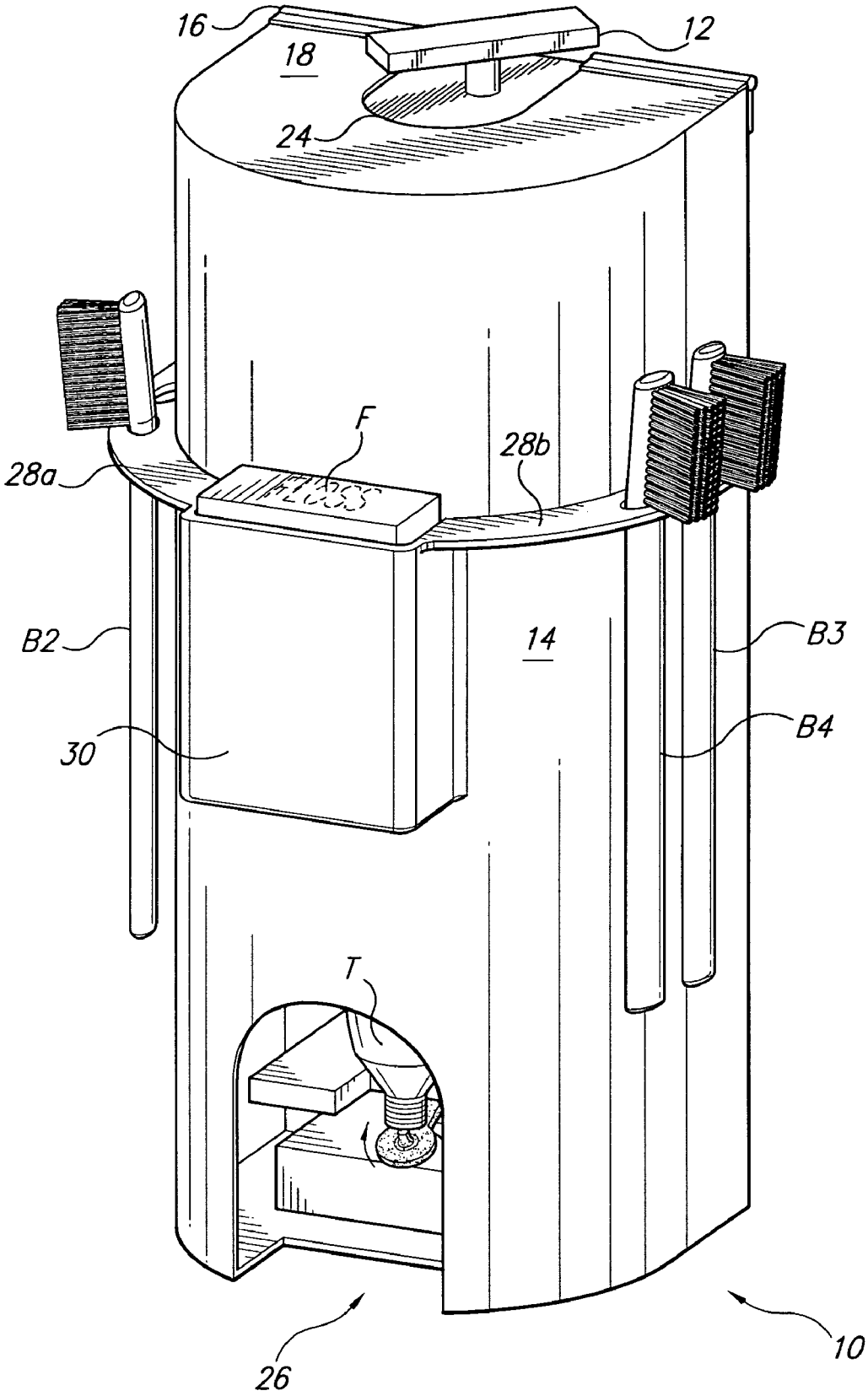
FIG. 2 is a top front perspective view of the personal dental care unit of the present invention with its cover closed, showing various details thereof.

FIGS. 1 and 2 provide external views of the present dental care unit 10 with its cover secured in place, with FIG. 1 providing a general environmental perspective view showing the use of the device 10 and FIG. 2 providing a larger, more detailed view showing further features thereof. In FIG. 1, the dental care unit 10 is shown mounted or attached to a bathroom wall W, adjacent the conventional sink and bathroom cabinet with mirrored door commonly found in bathrooms. The device 10, as shown in FIG. 1, is positioned for the convenience of smaller children, but the mounting location may be determined by the installer of the device as desired. In FIG. 1, a young child C is using the toothpaste dispensing knob or handle 12 extending from the top of the case or cover 14, to dispense toothpaste from a toothpaste tube T (shown in FIGS. 2 and 3) secured within the device onto a toothbrush B1.

FIG. 2 provides a more detailed drawing to show further features of the dental care unit 10. The device 10 includes a cover or outer case 14, shown having a generally semicylindrical shape in the drawings, but adaptable to any practicable shape as desired. The cover 14 has a laterally disposed hinge 16 along the rear edge of its upper surface or panel 18, allowing the cover 14 to be raised to access the toothpaste tube holding and dispensing mechanism within the cover 14. The hinge 16 is also attached to the upper edge 20 of the wall mounting plate 22 (shown in FIGS. 3 and 4, and discussed in detail further below) to secure the cover 14 to the remainder of the mechanism. A knob or handle clearance slot or passage 24 is provided in the upper panel 18 of the cover 14 in order to allow the cover 14 to clear the toothpaste-dispensing knob or handle 12 when the cover 14 is raised. A toothbrush clearance slot or passage 26 is provided at the lower front portion of the cover 14, to allow access to the nozzle of the toothpaste tube T contained therein.

The cover 14 provides at least a few features for the present dental care unit. First, the cover 14 conceals and protects the toothpaste tube T installed therein, as well as the tube securing and toothpaste dispensing mechanism of the device. Second, the cover 14 includes an external toothbrush rack, comprising rack portions 28*a* and 28*b* disposed to either side of the center of the device. The toothbrush rack preferably holds a plurality of toothbrushes therein, e.g., brushes B1 (removed for use as shown in FIG. 1), B2, B3, B4, etc. Finally, the cover 14 includes an externally disposed receptacle 30 for holding a container of dental floss F or the like therein. The receptacle 30 may have a cover or closure, or may have an open top, as shown.

Figure 3:
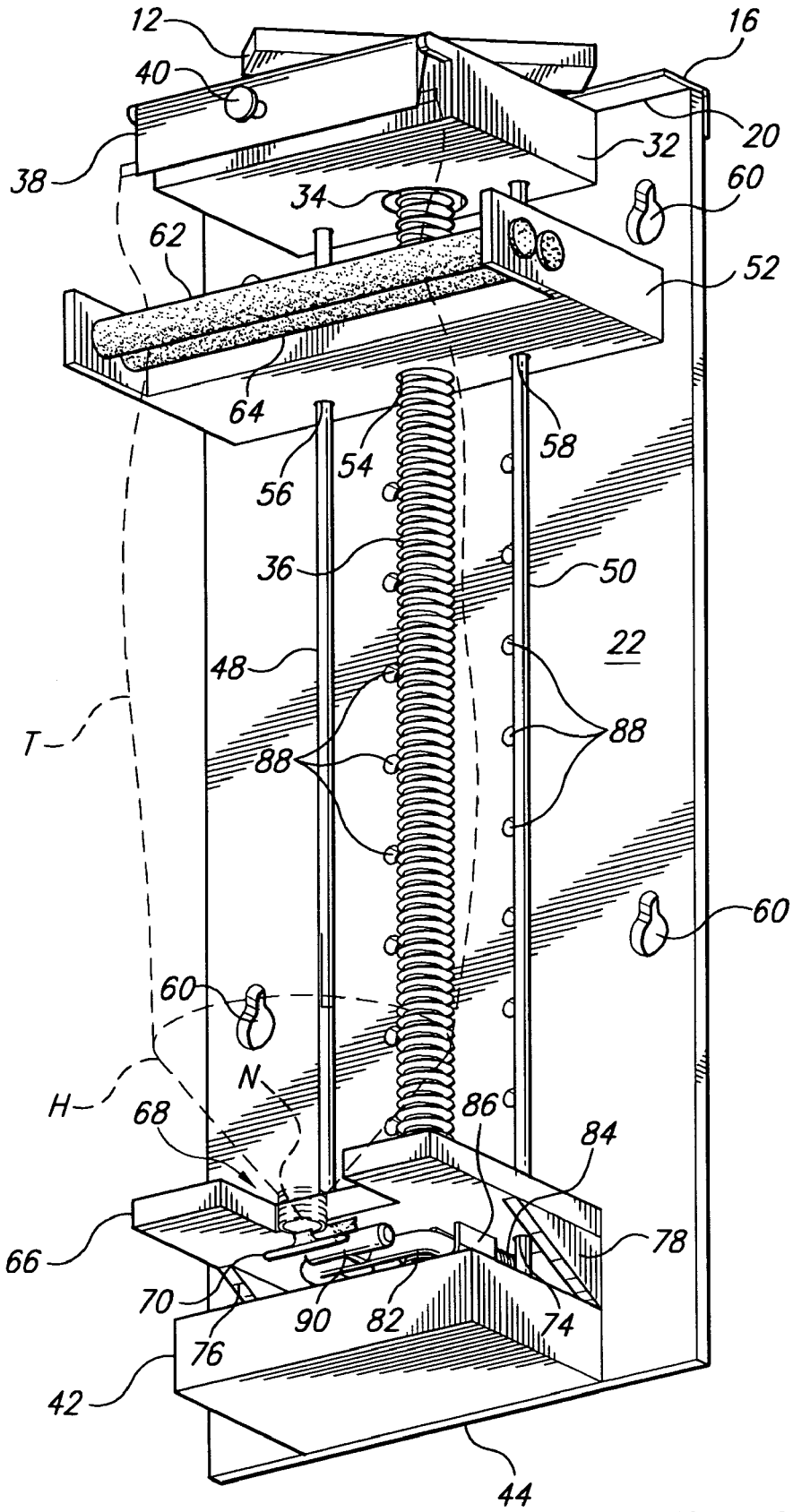
FIG. 3 is a bottom front perspective view of the personal dental care unit of the present invention with the cover removed to show further details of the operating mechanism.
Figure 4:
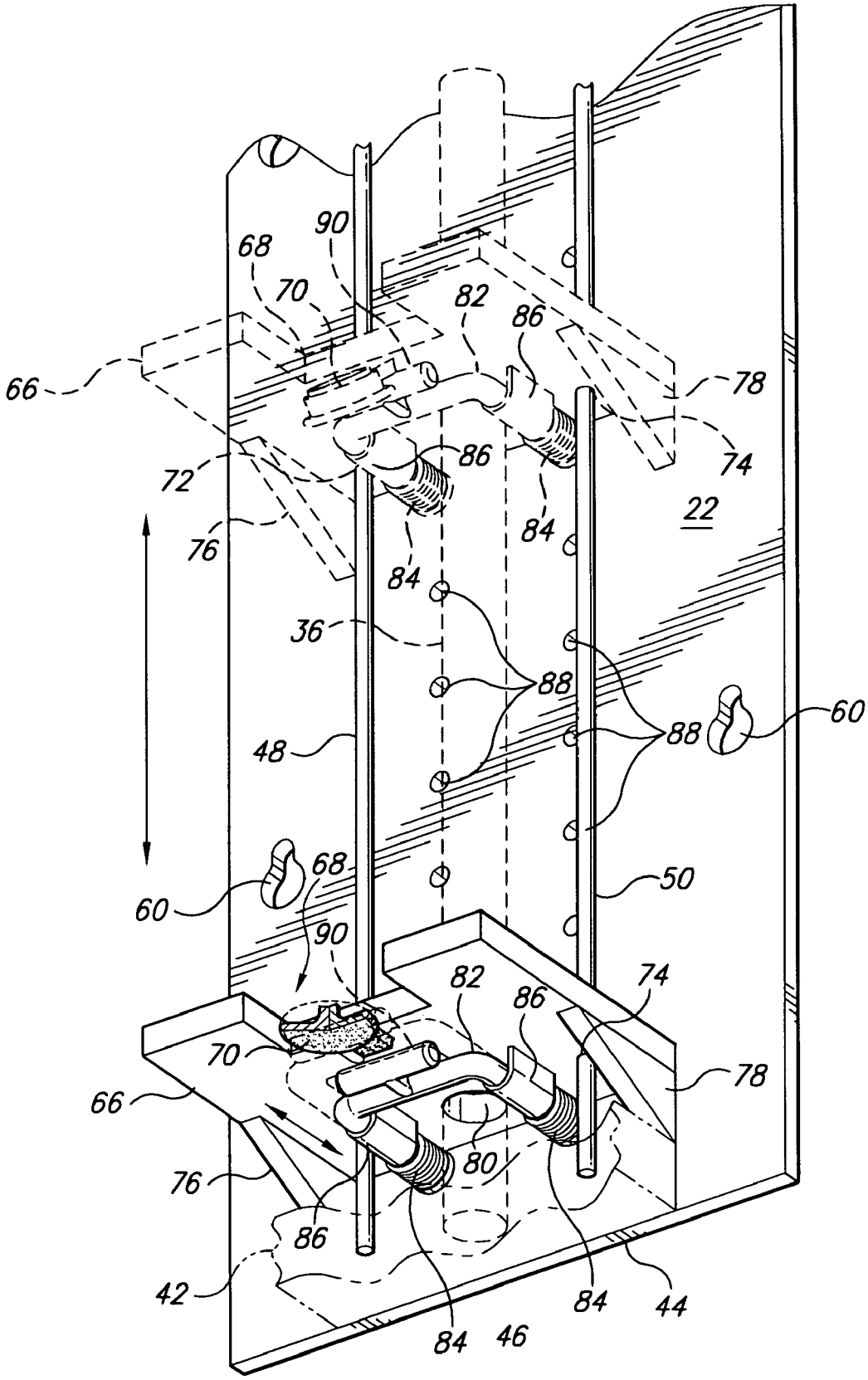
FIG. 4 is a bottom front detail perspective view of the tube support bracket of the personal dental care unit of the present invention and its adjustment mechanism.

FIGS. 3 and 4 illustrate the internal mechanisms for securing a tube T of toothpaste therein, as well as for dispensing toothpaste from the tube T. The mounting plate 22 includes a fixed upper block 32 extending outwardly or forwardly therefrom and adjacent the upper end 20 of the plate 22, with the upper block 32 having an unthreaded passage 34 therethrough for clearance for the roller frame advance screw 36. A conventional collar (not shown) may be affixed to the advance screw 36 below the upper block 32, to preclude axial movement of the advance screw upwardly through the upper block 32; other advance screw retaining means may be provided as desired. The upper block 32 also includes a toothpaste tube end securing clamp 38 disposed across its forward edge or end. The clamp 38 is secured to the end of a toothpaste tube T placed in the device 10 with a clamping screw 40 serving to tighten the clamp 38 along the end of the tube T.

A fixed lower block 42 extends outwardly or forwardly from the lower end 44 of the mounting plate 22 and serves to secure the lower end of the advance screw 36 therein. A seat or socket 46 or the like (indicated in the broken line showing of the lower block and advance screw in FIG. 4) may be provided in the lower block 42, with the lower end of the advance screw 36 residing in the advance screw seat 46 to secure the advance screw 36 within the two blocks 32 and 42. The unthreaded advance screw clearance passage 34 of the upper block 32 and the advance screw seat 46 in the lower block 42 are spaced the same distance from the mounting plate 22, in order to position the roller frame advance screw 36 parallel to the plate 22.

Laterally separated first and second guide rods, respectively 48 and 50, extend between the upper and lower blocks 32 and 42, with their ends anchored in the two blocks. These two guide rods 48 and 50 are also disposed parallel to the mounting plate 22, and provide guidance for the tube roller frame and tube outlet bracket, both discussed below.

A vertically positionable tube roller frame 52 includes an internally threaded roller frame advance screw passage 54 therethrough, with the passage 54 engaging the threads of the roller frame advance screw 36. As the advance screw 36 is rotated by the roller frame advance screw knob 12 extending from the upper end of the advance screw from the top 18 of the cover or housing 14, the roller frame 52 travels along the length of the advance screw 36. Assuming the advance screw 36 and roller frame advance screw passage 54 are provided with right hand threads, rotation of the advance screw knob 12, i.e., the toothpaste dispensing handle, in a counterclockwise direction will cause the roller frame 52 to travel downwardly along the advance screw 36 toward the lower block 42. Left hand threads will of course produce the same direction of travel for the roller frame 52 when the advance screw knob or toothpaste dispensing handle or knob 12 is rotated clockwise.

The roller frame 52 further includes first and second guide rod passages, respectively 56 and 58, parallel to the threaded roller frame advance screw passage 54. The guide rod passages 56 and 58, along with the stationary guide rods 48 and 50 passing therethrough, prevent the roller frame 52 from rotating about the advance screw 36 as it is turned. While the roller frame 52 cannot rotate significantly in any event due to its corners contacting the mounting plate 22 even if no guide rods were provided, the roller frame 52 is somewhat narrower than the upper and lower blocks 32 and 42 in order to provide clearance for the heads of mounting screws driven into the mounting holes 60 formed through the mounting plate 22. With the significant clearance between the back of the roller frame 52 and mounting plate 22, the roller frame 52 could rotate to some degree, possibly interfering with the heads of the mounting screws, if not restrained from rotation by the guide rods 48 and 50. The guide rod passages 56 and 58, as well as the threaded advance screw passage 54, are oriented normal to the plane of the roller frame 52, thus orienting the roller frame 52 normal to the mounting plate 22.

The roller frame 52 further includes closely spaced first and second tube gripping rollers, respectively 62 and 64, disposed laterally across the forward edge thereof. The two rollers 62 and 64 are positioned on opposite sides at the flattened tail end of the toothpaste tube T, and roll down along the sides of the tube T as the advance screw knob or toothpaste dispensing handle or knob 12 is rotated to advance the tube roller frame 52 downward along the body of the tube T, thereby forcing toothpaste from the nozzle N of the tube T.

The nozzle end or head H of the tube T is supported by a tube outlet bracket 66 adjustably secured to the mounting plate 22 and extending normal thereto. The tube outlet bracket may be repositioned along the mounting plate 22, in order to adjust for different sizes of tubes T installed in the device. The tube outlet bracket 66 includes a relief 68 to clear the nozzle N of the toothpaste tube T, with the remainder of the bracket 66 supporting the head H of the tube. A tube nozzle closure cap 70 extends on a flexible hinge from the back of the relief 68, and serves to close the tube nozzle N between uses of the device 10. The closure cap 70 and its flexible hinge may be similar to those found in various household products, such as dishwashing detergent bottles and the like, etc. The cap 70 and its hinge are preferably formed as a permanent, unitary, integral part of the tube outlet bracket 66, replacing the conventional threaded cap of the toothpaste tube T. The forming of the closure 70 as a permanent component of the tube outlet bracket 66 assures that the closure 70 cannot be lost, as often occurs with conventional toothpaste tube caps.

FIG. 4 provides a clearer illustration of the adjustability of the tube outlet bracket 66. The bracket 66 also includes first and second guide rod passages, respectively 72 and 74, and first and second support gussets 76 and 78 to each side thereof. The guide rod passages 72, 74 and support gussets 76, 78 assure that the tube outlet bracket 66 remains normal to the mounting plate 22 as it extends therefrom. The outlet bracket 66 also has an unthreaded clearance passage 80 formed therethrough for the roller frame advance screw 36 (shown in broken lines in FIG. 4), thus allowing the outlet bracket 66 to be adjustably positioned along the guide rods 48 and 50 independently of the operation of the advance screw 36.

The outlet bracket 66 includes a generally U-shaped latch 82 beneath the bracket's platform, with each arm of the latch 82 being urged toward the mounting plate 22 by a compression spring 84 disposed between a collar affixed to the latch arm and the corresponding latch retainer and guide sleeve 86. Each arm of the latch 82 selectively engages one of a pair of outlet bracket latching receptacles 88 disposed along the mounting plate 22. A handle 90 is provided at the front of the latch 82 to allow the user to manipulate the latch 82 and reposition it along the guide rods 48 and 50 to adjust for different lengths of toothpaste tubes, generally as indicated by the alternative positions of the outlet bracket 66 in solid and broken lines in FIG. 4. The close fit of the tube outlet bracket 66 about the advance screw 36 passing through the clearance hole 80 assures that the bracket 66 cannot shift outwardly from its position against the mounting plate 22.

The personal dental care unit 10 is easily installed upon a wall W or other surface as desired by raising the cover 14 to access the screw holes 60 in the mounting plate 22, positioning the device as desired, and driving mounting screws to secure the device 10 in place. The keyhole shaped screw holes allow the device to be lifted from its mounting screws for periodic cleaning or other maintenance as desired. A toothpaste tube T is installed within the device by positioning the roller frame 52 at or near the top of its travel adjacent the upper block 32 and clamping the crimped end, i.e., the end opposite the nozzle N, of the tube T in the tube end securing clamp 38 at the front of the upper block 32. The tube outlet or support bracket 66 is then adjusted to a position adjacent the outlet end or head H of the tube T, with the nozzle N of the tube extending through the relief area 68 of the bracket 66. The conventional cap is removed from the tube nozzle N, and the integral tube outlet closure 70 is secured over the end of the tube nozzle N. Finally, the cover 14 is lowered to complete the process.

In conclusion, the present personal dental care unit provides a convenient means of locating all of the commonly used articles and supplies for daily home dental care, in a single unit. The advance screw mechanism for dispensing toothpaste from a tube contained within the device greatly facilitates the application of toothpaste onto a brush for many people. Persons with arthritis or other injuries or infirmities who may have difficulty grasping and squeezing a toothpaste tube, will find the present dental care unit to be a most valuable accessory to the home. Parents of small children will appreciate the benefits of the present dental care unit as well, since small children often have difficulty in holding and squeezing a toothpaste tube with one hand while holding a toothbrush in the other hand. The mechanism of the present device assures that the proper amount of toothpaste is dispensed every time, as a predetermined number of degrees of rotation of the toothpaste dispensing advance screw knob serves to advance the roller frame a corresponding amount, thereby delivering a consistent amount of toothpaste every time and reducing waste.

It will be seen that the present device is not limited only to use as a dental care unit in the bathroom. Many viscous materials are supplied in tubes, and the present device may be used as a dispenser for such materials as well. For example, hand cleaner is often found in collapsible tube type containers, and the present device may be installed in automotive shops and the like to dispense such materials. The brush-holding rack is most convenient for holding brushes for cleaning beneath the fingernails and scrubbing at stubborn grease spots, in such an installation or environment. Certain lubricants are also sometimes provided in collapsible tubes, and the present dispenser is well suited for use with such lubricant tubes as well. Accordingly, the present device will be much appreciated in many environments of use, including various locations and environments where materials are commonly dispensed from a tube.

It is to be understood that the present invention is not limited to the embodiment described above, but encompasses any and all embodiments within the scope of the following claims.

We claim:

1. A personal dental care unit, comprising:

a mounting plate having an upper end and a lower end;

an upper block extending normal from said mounting plate, the upper block having a roller frame advance screw passage formed therethrough;

a lower block extending normal from said mounting plate, the lower block having a roller frame advance screw seat formed therein;

a tube securing clamp disposed across said upper block;

first and second laterally spaced guide rods extending between said upper block and said lower block parallel to said mounting plate;

a threaded roller frame advance screw disposed between said upper block and said lower block parallel to said mounting plate;

a roller frame having first and second guide rod passages and a threaded roller frame advance screw passage formed therethrough, the frame being adjustably disposed upon said guide rods and said roller frame advance screw between said upper block and said lower block, the frame extending normal to said mounting plate;

first and second tube gripping rollers disposed across said roller frame;

a tube outlet bracket extending normal from said mounting plate and being slidable along said guide rods; and a tube outlet bracket latch disposed upon said tube outlet bracket and selectively engaging said mounting plate for selectively positioning said tube outlet bracket upon said mounting plate;

whereby said tube securing clamp is adapted for securing a lower end of a toothpaste tube, the tube being suspended from the upper block, said first and second rollers being adapted for squeezing toothpaste from the tube when the advance screw is rotated.

2. The personal dental care unit according to claim 1, further including a selectively openable and closable tube closure permanently attached to and extending from said tube outlet bracket.

3. The personal dental care unit according to claim 1, further including a roller frame advance screw knob extending from said roller frame advance screw adjacent said upper block.

4. The personal dental care unit according to claim 1, further including a selectively opening cover pivotally attached to, and extending from, the upper end of said mounting plate.

5. The personal dental care unit according to claim 4, further including at least one toothbrush holder rack disposed upon said cover.

6. The personal dental care unit according to claim 4, further including a floss container receptacle disposed externally upon said cover.

7. A personal dental care unit, comprising:

a mounting plate having an upper end, a lower end, and a plurality of tube outlet bracket latching receptacles defined therein, the mounting plate being adapted for attachment to a vertical support;

a pair of guide rods disposed parallel to said mounting plate;

a tube outlet bracket slidably disposed upon said guide rods, the bracket extending normal to said mounting plate;

a tube outlet bracket latch disposed upon said tube outlet bracket and selectively engaging said tube outlet bracket latching receptacles for selectively positioning said tube outlet bracket;

means for suspending a toothpaste tube parallel to said mounting plate with an outlet of the tube resting on said bracket; and means for dispensing toothpaste from the toothpaste tube, wherein said means for dispensing comprises:

a roller frame having a pair of rollers mounted thereon, the frame being slidably disposed on said guide rods, the rollers being adapted for compressing opposite sides of the toothpaste tube to dispense toothpaste from the tube;

upper and lower blocks extending normal to said mounting frame, said guide rods extending between the upper and lower blocks; and a roller frame advance screw having a lower end retained in said lower block and an upper end extending through the upper block, the advance screw being threaded through said roller frame, whereby the roller frame is raised and lowered when the advance screw is rotated.

8. The personal dental care unit according to claim 7, further including a selectively openable and closable tube closure permanently attached to and extending from said tube outlet bracket.

9. The personal dental care unit according to claim 7, further including a selectively opening cover pivotally attached to and extending from the upper end of said mounting plate.

10. The personal dental care unit according to claim 9, further including at least one toothbrush holder rack disposed upon said cover.

11. The personal dental care unit according to claim 9, further including a floss container receptacle disposed externally upon said cover.

12. The personal dental care unit according to claim 7, wherein said means for suspending comprises an upper block extending normal from the upper end of said mounting plate and a clamp extending across an outer edge of the upper mounting block.

* * * * *